US006119619A

United States Patent [19]

Fitzmaurice

[11] Patent Number: 6,119,619

[45] Date of Patent: Sep. 19, 2000

[54] BOAT ANCHOR

[76] Inventor: Alan Fitzmaurice, P.O. Box 203, Mourilyan N.Q. 4858, Australia

[21] Appl. No.: 09/374,187

[22] Filed: Aug. 13, 1999

[51] Int. Cl.[7] ..... B63B 21/24

[52] U.S. Cl. ..... 114/301; 114/294

[58] Field of Search ..... 114/294, 301; 294/66.1, 82.1

[56] References Cited

U.S. PATENT DOCUMENTS

| | | | |
|---|---|---|---|
| 1,334,839 | 3/1920 | Cole | 294/66.1 |
| 2,602,689 | 7/1952 | Matz | 294/66.1 |
| 3,277,857 | 10/1966 | Canatella . | |

FOREIGN PATENT DOCUMENTS

| | | |
|---|---|---|
| 51037/73 | 7/1974 | Australia . |
| 38092/78 A1 | 1/1980 | Australia . |
| 84470/82 | 2/1983 | Australia . |
| 544852 | 2/1932 | Germany . |

*Primary Examiner*—Ed Swinehart

*Attorney, Agent, or Firm*—Samuels, Gauthier & Stevens, LLP

[57] ABSTRACT

There is disclosed an anchor for anchoring boats in areas where there are reefs or a rocky seabed. In one embodiment four prongs extend from the end of an anchor shaft, the prongs including stem section with terminating portions making an arcuate angle with corresponding stem section. The stem sections are fixedly attached to the shaft and angled relative to the shaft axis in order that the free end of the terminating portion is longitudinally offset from the end of the shaft and radially offset also. The longitudinal offset being substantially greater than the radial offset.

9 Claims, 3 Drawing Sheets

BOAT ANCHOR

FIELD OF INVENTION

The present invention relates to boat anchors. for use in anchoring boats in areas where there are reefs or rocky seabeds.

PRIOR ART

Anchors used to anchor on reefs and rocky seabeds typically include a shank with multiple arcuate prongs radiating from one end of the shank. When the anchor rests on the seabed, the arcuate prongs tends to prop-up the free end of the shank above the opposing end which is weighed down by the anchor line. The arcuate prongs are resilient but sufficiently pliable whereby they may be straightened in by pulling on the anchor line to free the anchor from a snag. During anchoring especially in windy conditions, the resilience of the prongs and their configuration engenders them with a tendency to skip along the seabed and over obstacles on which they might otherwise catch and effect anchoring. This may damage reef and/or prevent anchoring.

In addition the motion of an anchored boat lifting to the swells may cause the line attachment end of the anchor to lift and this joggling action can also cause release of an anchor from its engaged attitude Further, when one or more of the prongs grips the seabed in adverse conditions, the resultant load on the gripping prong may tend to straighten the engaged prongs, releasing its grip and rendering it useless, causing the anchor to be ineffective in gripping the seabed. As this is most likely to occur in windy conditions, the drifting vessel may be at risk especially as Its operator may not be aware immediately of the dragging anchor.

SUMMARY OF THE INVENTION

The present invention aims to provide an improved anchor for anchoring boats in areas where there are reefs or a rocky seabed.

With the foregoing in view, this invention in one aspect broadly resides in an anchor of the type having an elongate shank formed with a line attachment at one end and a plurality of prongs extending from its opposite end, and characterised in that each prong includes a stem portion which diverges longitudinally away from the axis of the elongate shank and a terminating portion returned outwardly from the outer end of the stem portion and disposed in or adjacent a plane radiating from the shank axis, the tip of the terminating portion being spaced radially from the shank axis and longitudinally from the adjacent end of the shank a distance greater than said radial spacing.

There are at least three or more prongs and preferably four arranged about the shank and suitably arranged symmetrically about the shank. The prongs may be formed from resilient material such as galvanised low carbon spring steel. The prongs are suitably formed from slender bar-like material with the terminating portion of each prong forming a hook at the outer end of the respective prong. The base of the hook may be a sharp angular bend, a square or a curved U-shaped bend, Suitably the included angle between the returned terminating portion and the stem is greater than the included angle between the stem and the axis of the shank and typically the included angle between the returned terminating portion and the stem is in the order or 20° to 60° and the included angle between the stem and the axis of the shank is in the order of 10° to 30°.

In a typical embodiment the prongs extend longitudinally from the shank a distance which is substantially equal to the length of the shank, the included angle between the returned terminating portion and the stem is about 40° and the included angle between the stem and the axis of the shank is about 15°.

The anchor is preferably formed from stainless steel or mild steel and/or spring steel. Suitably the shank is formed from heavy bar or pipe and the prongs are about one-third the thickness of the shank. Suitably both the shank and prongs have a circular cross-sectional configuration. The terminating portion may terminate in a point or it may be blunt. In a typical embodiment, each terminating portion is terminated as a wedge-shaped end.

The configuration of the shank and the prongs may be varied to suit different seabeds.

BRIEF DESCRIPTION OP THE DRAWINGS

In order that this invention may be more readily understood, reference will now be made the accompanying drawings which illustrate a typical embodiment of the invention, wherein:

FIG. 1 is a diagrammatic perspective view of an embodiment of the present invention;

FIG. 2 provides a side view of the anchor and an alternative line connection, and FIGS. 3 and 4 illustrated the deployment of a anchor according to this invention and a conventional reef anchor, respectively.

DETAILED DESCRIPTION OF THE PREFERRED EMBODIMENT

Figure 1:
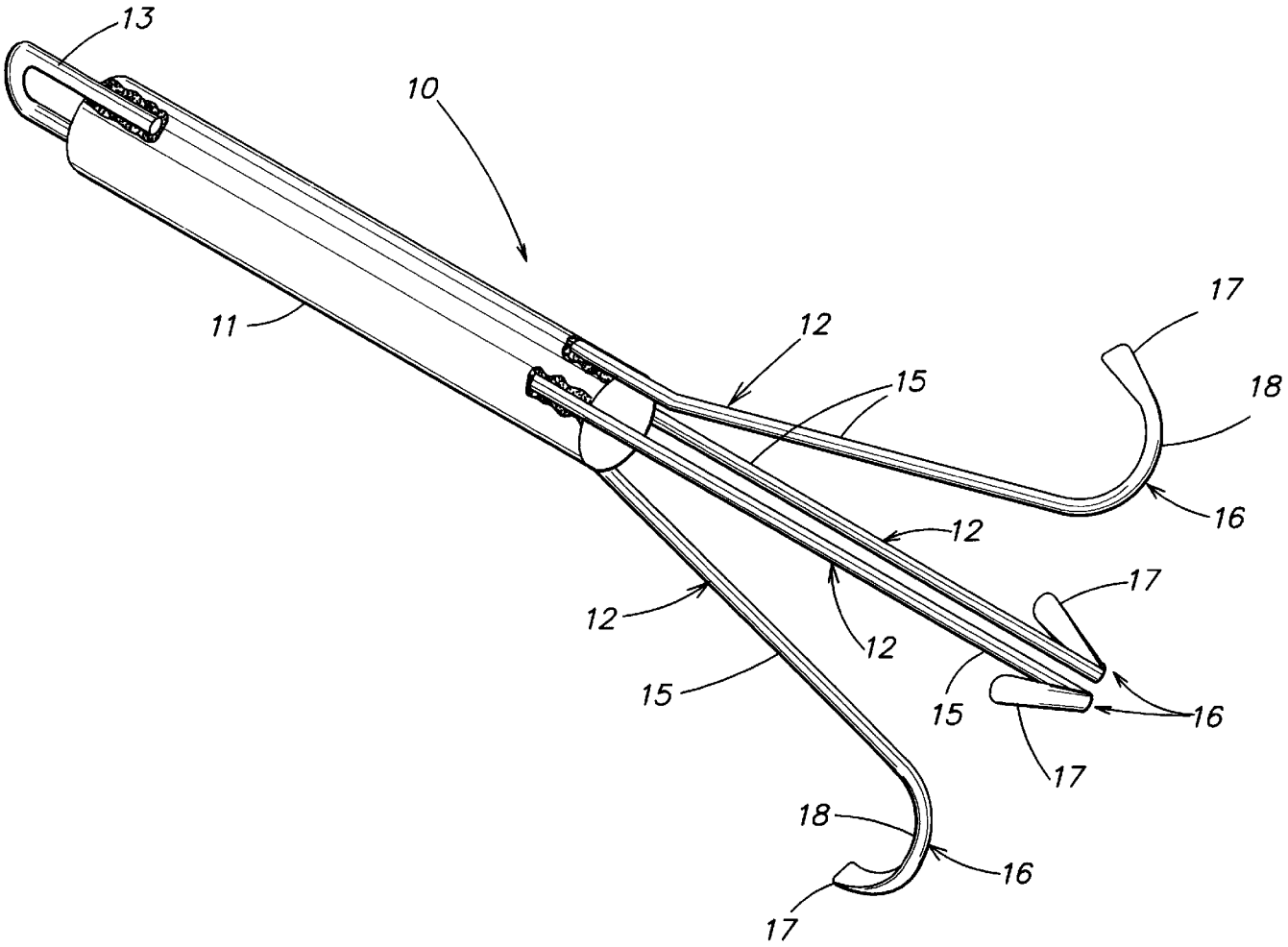

The anchor 10 has a shank 11 and four prongs 12 extending from one end of the shank 11. The other end of the shank 11 is formed with an eye 13 for attaching an anchor line.

Each of the prongs 12 has a stem 15 attached to the shank 11 and diverging therefrom at angle B, about 15° to the axis 14 of the shank 11 as illustrated. A hook 16 is formed at the outer end of the stem 15 by return of a terminating portion 17, the free end or point of which is chisel or wedge shaped as illustrated at 19. The stem 15 separates the hook 16 from the shank 11 in both the lateral and longitudinal directions. In the illustrated embodiment the hook 16 is spaced longitudinally from the shank 11 a distance which Is approximately equal to the length of the shank, and the hook 16 is spaced laterally from the axis 14 of the shank about half that longitudinal spacing.

The hook 16 Includes a curved base 18 and an included angle A of approximately 40° is provided between the terminating portion 17 and the stem 15. This configuration accommodates use on an uneven seabed while maintaining the hook 16 in an effective anchoring attitude.

Figure 2:
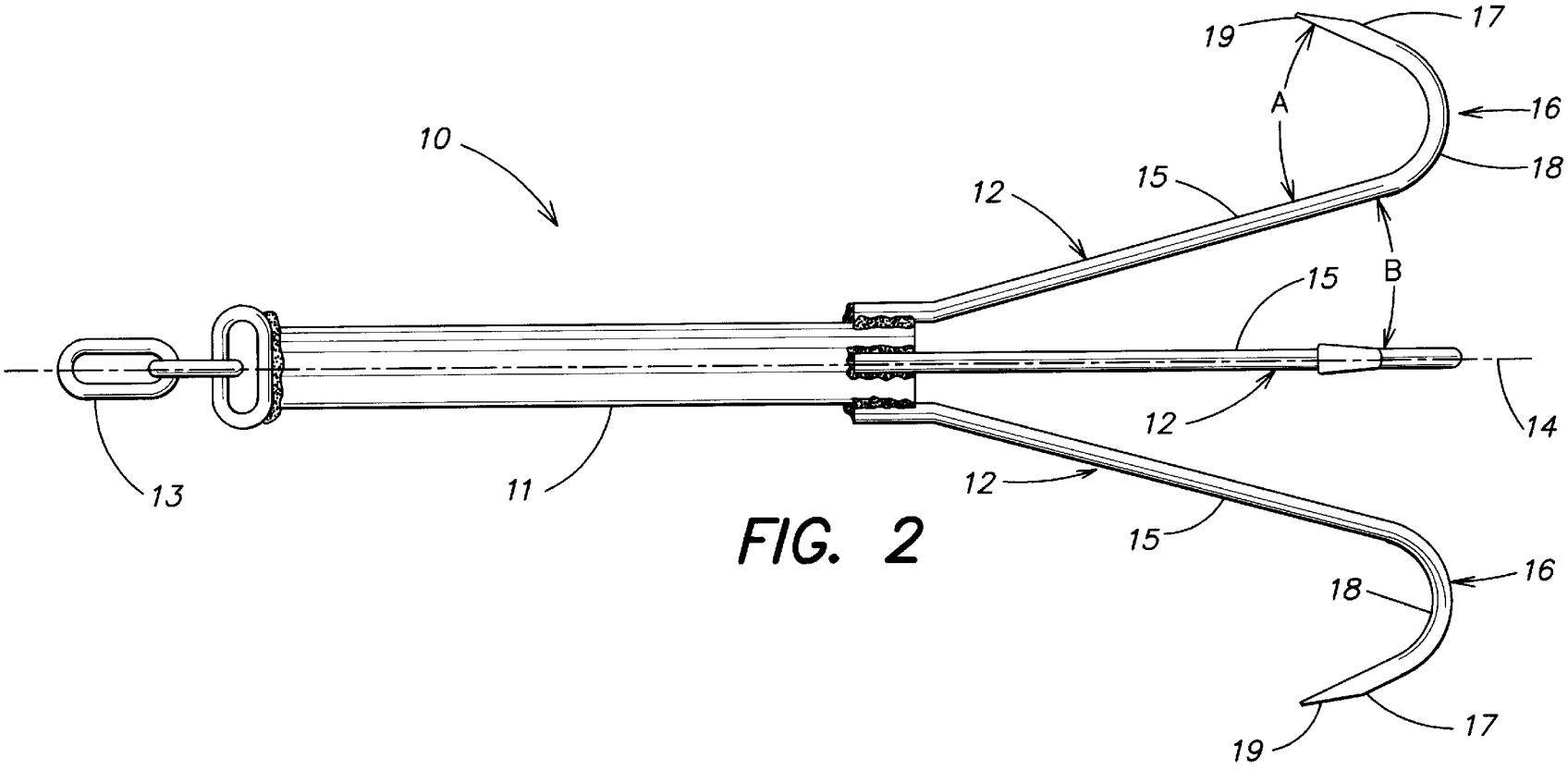
Figure 2A:
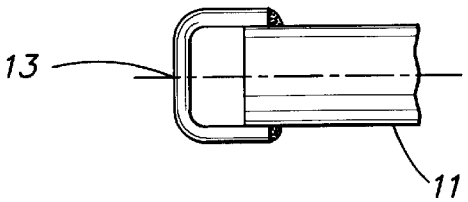
Figure 3:
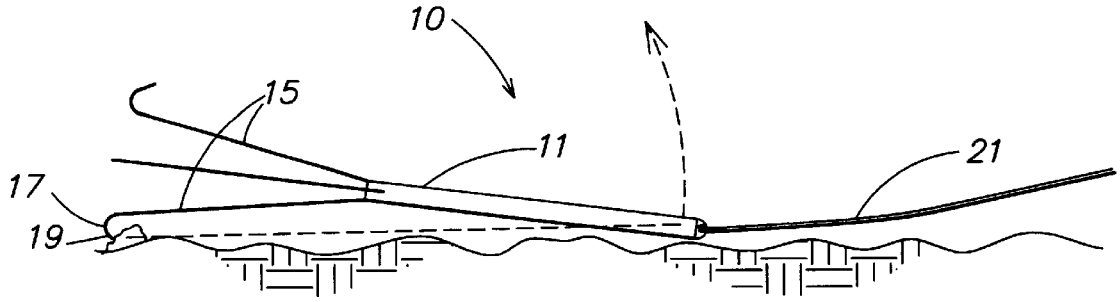

A typical anchor as per FIG. 2 and suitable for use as an anchor for a small cabin cruiser would have a solid round bar stem of 32 mm diameter and 300 mm long and four equally spaced stems welded thereto and formed from round bar 10 mm diameter and 350 mm long with the returned terminating portions extending 80 mm from the base of the anchor.

Figure 4:
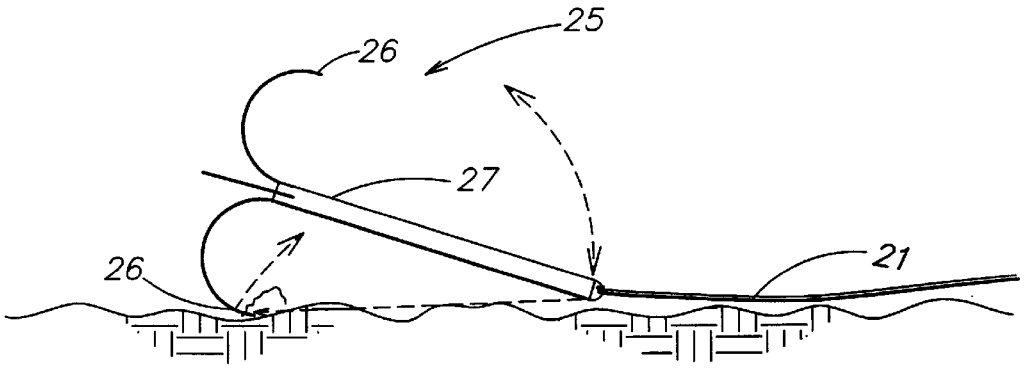
FIG. 4 (PRIOR ART)

In use when the anchor 10 is lowered to the seabed on a suitable length of anchor line one or more of the hooks 12 will be positioned in an engaging attitude to catch any solid protuberance as the anchor 10 drags across the seabed. The chances of the anchor skipping over a suitable anchoring protuberance are minimised by the configuration which places the hook end 19 close to the axis 14 whereby the pull direction exerted by the anchor line 21 passes close to the end 19 and any lifting tendency from the anchor line is damped by the relatively heavy shank located well forward of the hook ends 19, By comparison with a conventional reef anchor 25 Illustrated in FIG. 4, the prong ends 26 lie beneath the end of the shank 27 which is elevated above the seabed such that skipping of the anchor across the seabed is common and any upward pull on the anchor line will joggle the anchor through a considerable arc and possibly result in the anchor releasing from the protuberance.

Further, in an anchor according to this invention the terminating portion is relatively short compared to the stem and thus the anchor should release upon lifting of the line end of the shank as this action is likely to rotate the prongs out of engagement with the seabed. In addition the resultant small throat of the hook will prevent the anchor from gripping about 2 protuberance in a manner which will prevent lifting of the line end of the shank. Should the small hook become locked about a protuberance, the relatively long lever arm provided by the stems and shank should enable the hooked end to be forcibly rotated out of engagement with the protuberance or freed by jiggling of the anchor line.

It will of course be realised that while the foregoing has been given by way of example, all such and other modifications and variations thereto as would be apparent to persons skilled in the art are deemed to fall within the broad scope and ambit of this invention as defined in the appended claims.

What is claimed is:

1. An anchor comprising an elongate shank having a longitudinal axis, a line attachment formed at a first end of said shank, a plurality of prongs fixedly extending from a second end of said shank opposite to said first end, each prong including a stem portion diverging longitudinally away from said axis and terminating in a terminating portion having a free end ending in a tip, the terminating portion making an acute angle with said stem, the stem portion being arranged relative to said shank so that the free end is spaced radially from the point of attachment to the shank and longitudinally from the second end of the shank the longitudinal spacing being greater than the radial spacing.

2. The anchor according to claim 1 wherein said terminating portion is wedge shaped towards said free end for engaging a protuberance on a seabed.

3. The anchor according to claim 1 wherein said terminating portion is chisel shaped towards said free end for engaging a protuberance on a seabed.

4. The anchor according to claim 1 wherein said plurality of prongs number four.

5. The anchor according to claim 1 wherein the terminating portion of each prong is relatively short compared to the stem and forms a hook at the outer end of the corresponding stem.

6. The anchor according to claim 5 wherein said acute angle is in the range of 20° to 60° and the included angle between the stem and the axis of the shank is about 10° to 30°.

7. The anchor according to claim 5 wherein said acute angle is greater than the included angle between the stem and the axis of the shank.

8. The anchor according to claim 7 wherein the shank is formed from heavy bar and extends from the line attachment to a prong connection adjacent the mid-length of the anchor whereby said heavy bar operatively resists lifting forces applied by a line connected to the line attachment.

9. The anchor according to claim 8 wherein the prongs and the shank are formed from steel bar and the prongs are about one-third the thickness of the shank.

* * * * *